US009837236B2

(12) United States Patent
Hong et al.

(10) Patent No.: US 9,837,236 B2
(45) Date of Patent: Dec. 5, 2017

(54) HIGH-VOLTAGE DIRECT-CURRENT THERMAL FUSE

(71) Applicant: XIAMEN SET ELECTRONICS CO., LTD, Xiamen (CN)

(72) Inventors: Yaoxiang Hong, Xiamen (CN); Yousheng Xu, Xiamen (CN); Zhonghou Xu, Xiamen (CN)

(73) Assignee: XIAMEN SET ELECTRONICS CO., LTD, Xiamen (CN)

( * ) Notice: Subject to any disclaimer, the term of this patent is extended or adjusted under 35 U.S.C. 154(b) by 0 days.

(21) Appl. No.: 15/125,585

(22) PCT Filed: May 6, 2015

(86) PCT No.: PCT/CN2015/078386
§ 371 (c)(1),
(2) Date: Sep. 13, 2016

(87) PCT Pub. No.: WO2015/169223
PCT Pub. Date: Nov. 12, 2015

(65) Prior Publication Data

US 2017/0004947 A1 Jan. 5, 2017

(30) Foreign Application Priority Data

May 7, 2014 (CN) ..... 2014 2 0230161 U

(51) Int. Cl.
*H01H 85/38* (2006.01)
*H01H 85/30* (2006.01)
*H01H 85/04* (2006.01)

(52) U.S. Cl.
CPC ..... *H01H 85/38* (2013.01); *H01H 85/04* (2013.01); *H01H 85/30* (2013.01); *H01H 2085/381* (2013.01)

(58) Field of Classification Search
CPC ..... H01H 85/38; H01H 2085/381; H01H 2037/008; H01H 37/02; H01H 37/00;
(Continued)

(56) References Cited

U.S. PATENT DOCUMENTS 3,614,699 A * 10/1971 Fister ..... H01H 85/303 337/159
3,810,063 A * 5/1974 Blewitt ..... H01H 85/47 337/159
(Continued)

FOREIGN PATENT DOCUMENTS

CA 1189117 A1 6/1985
CN 2513223 Y * 9/2002
(Continued)

OTHER PUBLICATIONS

Li Dian, Closed high voltage fuse, Sep. 25, 2002, Ni Xuefeng (translation of CN 2513223).*
(Continued)

*Primary Examiner* — Jerry Wu
*Assistant Examiner* — Stephen Sul
(74) *Attorney, Agent, or Firm* — Gokalp Bayramoglu

(57) ABSTRACT

A high-voltage direct-current thermal fuse, includes a high-voltage low-current thermal fuse connected to a high-voltage direct-current circuit. The high-voltage low-current thermal fuse includes a casing, fusible alloy wires, and two leads extending out of the casing. The fusible alloy wires are connected between the two leads. One of the leads is sequentially sleeved with an arc extinguishing sleeve and a spring. One end of the arc extinguishing sleeve is in contact with the fusible alloy wires; and the other end of the arc extinguishing sleeve is in contact with the spring. One end of the spring is connected to the internal end face of the casing; and the spring is in a compressed state. The high-
(Continued)

voltage direct-current thermal fuse further includes a conventional thermal fuse connected in parallel to the high-voltage low-current thermal fuse; or further includes a current fuse connected in series with the high-voltage low-current thermal fuse.

7 Claims, 3 Drawing Sheets

(58) Field of Classification Search
CPC .... H01H 37/32; H01H 35/2607; H01H 37/18; H01H 7/06; H01H 61/00; H01H 73/00; H01H 83/00; H01H 89/04; H01H 37/006; H01H 37/002; H02H 5/04; H02H 5/047
USPC ..... 337/299, 14, 298, 342, 388, 18, 19, 20
See application file for complete search history.

(56) References Cited

U.S. PATENT DOCUMENTS 4,308,515 A * 12/1981 Rooney ..... H01H 85/055 337/162
4,948,828 A * 8/1990 Johnson ..... C08K 3/22 524/437
2007/0025042 A1* 2/2007 Nishikawa ..... H01H 37/761 361/104
2014/0152418 A1* 6/2014 Benke ..... H01H 85/30 337/227
2015/0043120 A1* 2/2015 Tahata ..... H02H 3/087 361/93.9
2015/0137934 A1* 5/2015 von zur Muehlen H01H 85/042 337/273

FOREIGN PATENT DOCUMENTS

CN 2513223 Y 9/2002
CN 102290301 A 12/2011
CN 203839326 U 9/2014
WO WO 2011157068 A1 * 12/2011

OTHER PUBLICATIONS

Jiang, Hongsheng, Controlled High Current Fuse-Link, Dec. 22, 2011, Xiamen Set Electronics (translation of WO 2011157068).*
Ni Xuefeng, Shi Ban, and Li Dian, "Closed high voltage fuse", Sep. 25, 2002, Entire Document (Translation of CN 2513223).*

* cited by examiner

HIGH-VOLTAGE DIRECT-CURRENT THERMAL FUSE

TECHNICAL FIELD

The invention relates to a high-voltage direct-current thermal fuse, particularly for a high-voltage direct-current thermal fuse used for cutting off arcs in high-voltage direct-current circuits.

BACKGROUND

The thermal fuse is also called a thermal fusible cutout, which is usually mounted in electrical appliances that are prone to generating heat. If the appliance fails and generates heat, and if the temperature exceeds normal temperature ranges, the thermal fuse will automatically fuse to cut off the appliance's power supply to prevent the electric appliance from catching fire. In recent years, the thermal fuse has been mounted on most household appliances that primarily operate as sources of heat, such as rice cookers, electric irons, and electric furnaces. When internal parts stop working, the thermal fuse can cut off the power supply to prevent the appliance from further internal damage to the appliance, and to avoid causing a fire of the appliance and anything surrounding the appliance. Fuses are well known in the prior art, and thermal fuses work as a path of the power in the circuit. The thermal fuse does not melt until the current in the circuit exceeds thermal fuse's rated value. The thermal fuse has a relatively lower resistance, a relatively smaller power loss and a relatively lower surface temperature. In case of an abnormal temperature due to a failure of an electrical appliance, the thermal fuse melts and thus cuts off the power supply of the circuit.

The thermal fuse plays a role in protection from excessive temperatures in the power supply circuit. If the temperature of the region where the thermal fuse is located reaches the fusing-off temperature of the fusible alloy wire inside the thermal fuse, then, the fusible alloy wire shrinks towards the leads at both ends to cut off the circuit with the help of the fusing agent. The current circuit is thereby cut off to prevent other components in the circuit from being further damaged by the excessive temperature. Thus, the thermal fuse is applied in many circuits that need protection from excessive temperatures. Different circuits have different requirements for the thermal fuse.

In a direct current circuit with a high voltage level of 400V or above, during the process of fusing the fusible alloy wire of the traditional thermal fuse, an arc is generated due to the low shrinking speed of the fusible alloy wire and the small gap between the two leads, so that the circuit cannot be cut off in time. The circuit may be destroyed and/or catch fire due to the occurrence of the arc, as well as the high-temperature of the circuit. Thus, if the existing thermal fuse is used in a direct current circuit with a voltage level of 400V or above, the existing thermal fuse not only fails to cut off the circuit in time to protect the circuit, but also may cause additional problems.

SUMMARY OF THE INVENTION

The embodiment of the invention is aimed at the problem that the existing thermal fuse cannot be directly used in a high-voltage circuit, the invention therefore provides a high-voltage direct-current thermal fuse to solve the problem of cutting off the circuit and preventing an arc in time. The high-voltage direct-current thermal fuse can be directly used in the high-voltage direct-current circuit.

The specific solution is as follows: a high-voltage direct-current thermal fuse at least comprising a high-voltage low-current thermal fuse connected into a high-voltage direct-current circuit. The high-voltage low-current thermal fuse comprises a casing, a fusible alloy wire encapsulated in the casing, and two leads extending outside the casing. The fusible alloy wire is connected between the two leads. One of the leads is sequentially sleeved with an arc extinguishing sleeve and a spring. One end of the arc extinguishing sleeve contacts the fusible alloy wire, and the other end of the arc extinguishing sleeve contacts the spring. One end of the spring is connected to the internal end face of the casing, and the spring is in a compressed state.

The high-voltage low-current thermal fuse has the functions of high-voltage low-current arc extinguishing and cutting-off protection. Since the fusible alloy wire has a certain stiffness under normal temperature, the arc extinguishing sleeve pushes against the fusible alloy wire under the effect of the compressing spring. The elasticity of the compressing spring in the compressed state is not sufficient to destroy the welding strength of the fusible alloy wire and leads. Thus, the fusible alloy wires retain good fluidity in a liquefied state at temperatures above the fusing temperature of the fusible alloy wires when the high-voltage low-current thermal fuse is connected into the high-voltage direct-current circuit The arc extinguishing sleeve moves along the axis under the effect of the elasticity of the compressing spring to cut off the fusible alloy wire and to cover one lead, such that the discharging gap between the two leads is insulated to avoid the generation of a high-voltage arc.

As a preferable embodiment, in order to better prevent arcing in the high-voltage direct-current circuit, the embodiment of the invention also provides a high-voltage direct-current thermal fuse. The high-voltage direct-current thermal fuse includes a second thermal fuse, which is connected in series into the high-voltage direct-current circuit. The high-voltage low-current thermal fuse is connected in parallel to the second thermal fuse. The fusing temperature of the high-voltage low-current thermal fuse is higher than that of the second thermal fuse.

As a preferable embodiment, the high-voltage low-current thermal fuse is connected in series with a current fuse to form a primary branch. The primary branch is connected in parallel to the other thermal fuse. The resistance of the current fuse is then more than that of the high-voltage low-current thermal fuse.

According to the above arrangements, when the circuit to be protected is a high-voltage, high-current circuit, after the temperature reaches the melting point of the second thermal fuse to fuse the circuit, the current will go through the primary branch in parallel. Since the resistance of the current fuse is more than that of the high-voltage low-current thermal fuse, the current fuse fuses off first, and cuts off the primary branch in parallel. When the circuit to be protected is a high-voltage, low-current circuit, after the temperature reaches the melting point of the second thermal fuse to fuse the circuit, the current will go through the primary branch in parallel. Then, since the low current cannot make the current fuse in the primary branch fusing, the temperature continues to increase till the melting point of the high-voltage low-current thermal fuse, the high-voltage low-current thermal fuse cuts off the primary branch in parallel as a way of cutting-off high voltage circuits and preventing excess temperatures.

As a preferable embodiment, the current fuse is a tube fuse, which includes a metal fusing wire inside the tube and a tube body with both ends having a metal connecting terminal. Preferably, the current fuse is the N-type current fuse, which includes a fuse-link and the two leads connecting to both ends of the fuse-link. The two leads extend from the top of the N-type fuse-link, and have segments in parallel to each other. When the high-voltage low-current thermal fuse is connected in parallel to the N-type current fuse, the breaking current of the high-voltage low-current thermal fuse is less than that of the N-type current fuse. As a preferable embodiment, the N-type fuse-link is encapsulated inside the casing, and the casing is filled with arc extinguishing material, such as quartz sand. The N-type current fuse has the function of high-voltage high-current arc extinguishing. Compared to the product with a linear cavity structure, the parallel leads of the current fuse with the N-type fuse-link generate much higher electric field at the moment of fusing off. The diffusion and recombination process of charged particles is more rapid as electric field intensity increases, allowing the gap between the electrode leads to quickly return to the insulation state, so as to achieve the aim of extinguishing the arc. Thus, the arc extinguishing protection function of the new fuse is multiple times more effective than that of the normal fuse.

As a preferable embodiment, the second thermal fuse includes at least one fusible alloy wire. The fusible alloy wire is provided between the two leads. Specifically, it is welded between the two leads by soldering.

The second thermal fuse in the embodiment of the invention includes an insulated casing and a base. The fusible alloy wire and two leads are arranged inside the cavity formed by the insulated casing and the base. Specifically, the fusible alloy wire is welded between the two leads. The ends of both leads extend outside the base. One or more pieces of fusible alloy wires can be provided between the two leads according to actual needs. The number thereof is not limited.

As a preferable embodiment, the second thermal fuse in this embodiment includes two pieces of fusible alloy wires. The two pieces of fusible alloy wires are welded in parallel or crossways between the two leads to form a bridge-type connection. The opposite ends of the two leads are outside the base. The symmetrical structure of two L-type leads contributes to the uniformity of the alloy wires in parallel and improves effective utilization of flow capacity in parallel.

As a preferable solution, the high-voltage low-current thermal fuse is a square-shell type, a porcelain-tube type thermal fuse, or other alloy thermal fuse usually used in this field. The working principle of the alloy thermal fuse is the same. Different types of thermal fuses can be selected according to the actual needs of the circuit.

As a preferable embodiment, the high-voltage direct-current thermal fuse of the embodiment of the invention also includes several (N) secondary branches. The secondary branches include a high-voltage low-current thermal fuse and a current fuse that are connected in series sequentially. Among others, the structure of the high-voltage low-current thermal fuse and that of the current fuse are the same as those of the primary branch, which is not explained again here. When N equals 1, the secondary branch is connected in parallel to the high-voltage low-current thermal fuse in the primary branch. When N is more than 1, the Nth secondary branch is connected in parallel to the high-voltage low-current thermal fuse in the (N−1)th secondary branch. Using the manner of multi-parallel connecting to the high-voltage low-current thermal fuse, high-voltage low-current thermal fuse can be expendably applied in the lightning protection module. Thus, the protected circuit can be cut off more effectively and timely cut off.

The invention makes an improvement to the internal structure of the existing thermal fuse to solve the problem that the existing thermal fuse cannot be directly used in high-voltage circuits. The present invention allows a high-voltage low-current thermal fuse to be directly used in a high-voltage direct-current circuit for protection. When the heat generated by the circuit is too high, the fuse can cut off the circuit to avoid further damage to the electronic components and the occurrence of fire.

Furthermore, the embodiment of the invention also provides an improved solution of the high-voltage direct-current thermal fuse. The circuitry design in which the high-voltage low-current thermal fuse is connected in series to the current fuse and further connected in parallel to the other thermal fuse, results in extinguishing the voltage arc in a timely manner. As a result, in conditions of both high-voltage low-current, and high-voltage high-current, the arc can be extinguished and the circuit can be cut off in time, to prevent further damage to other components in the circuit resulting from an abnormal increase of temperature or burning caused by the arc. In addition, the high-voltage direct-current thermal fuse of the invention can be expanded using the manner of multi-parallel connecting to the high-voltage low-current thermal fuse, so that the high-voltage direct-current thermal fuse can be used in a lightning protection module.

BRIEF DESCRIPTION OF THE DRAWINGS

Referring to the following drawings, further descriptions are made to the invention, wherein.

In the text, the same reference numbers denote the same parts. When describing the drawings, not all the parts or components shown need to be discussed together with the corresponding drawings. Among others, the reference numbers are as follows.

Figure 1:
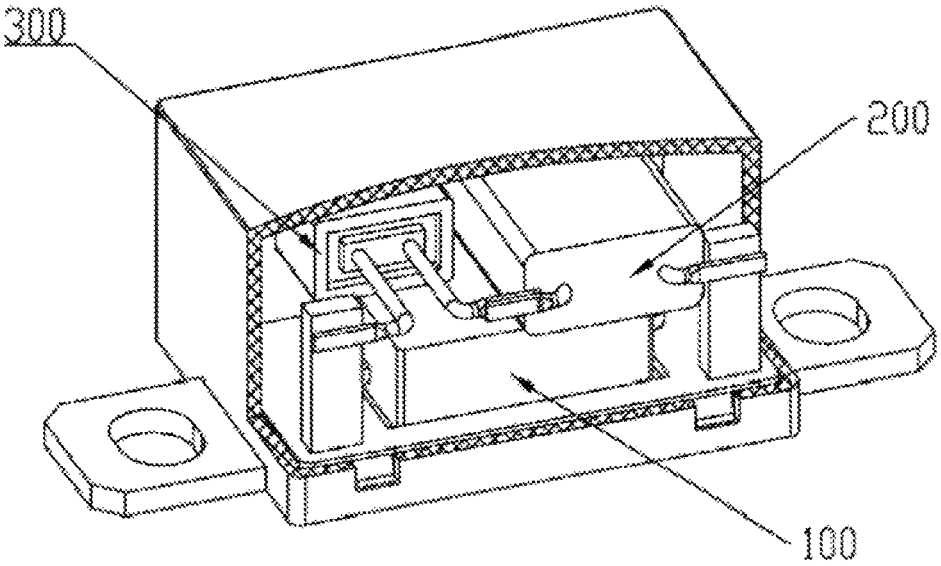
FIG. 1 is a perspective partial profile diagram of Embodiment 1 of the invention.

100—another thermal fuse/conventional temperature fuse, 101—insulating base, 102—small casing, 103—large casing, 104—fusible alloy wires, 105—left lead of the thermal fuse, 106—right lead of the thermal fuses;

200—current fuse, 201—casing of current fuse, 202—cover plate, 203—fuse, 204—left lead of the current fuse, 205—right lead of the current fuse;

300—high-voltage low-current thermal fuse, 301—casing of high-voltage low-current thermal fuse, 302—base, 303—fusible alloy wires, 304—arc extinguishing sleeve, 305—compressing spring, 306—left lead of the high-voltage low-current thermal fuse, 307—right lead of the high-voltage low-current thermal fuse.

DETAIL DESCRIPTION OF THE EMBODIMENTS

Hereinafter, embodiments of the invention will be described more completely by means of embodiments referring to the drawings. Among others, only some embodiments have been shown. However, in practice, embodiments of the invention can be embodied in many different forms, but not limited to the embodiments in the text. These embodiments are provided for the purpose of better understanding of the invention.

Embodiment 1

Figure 2:
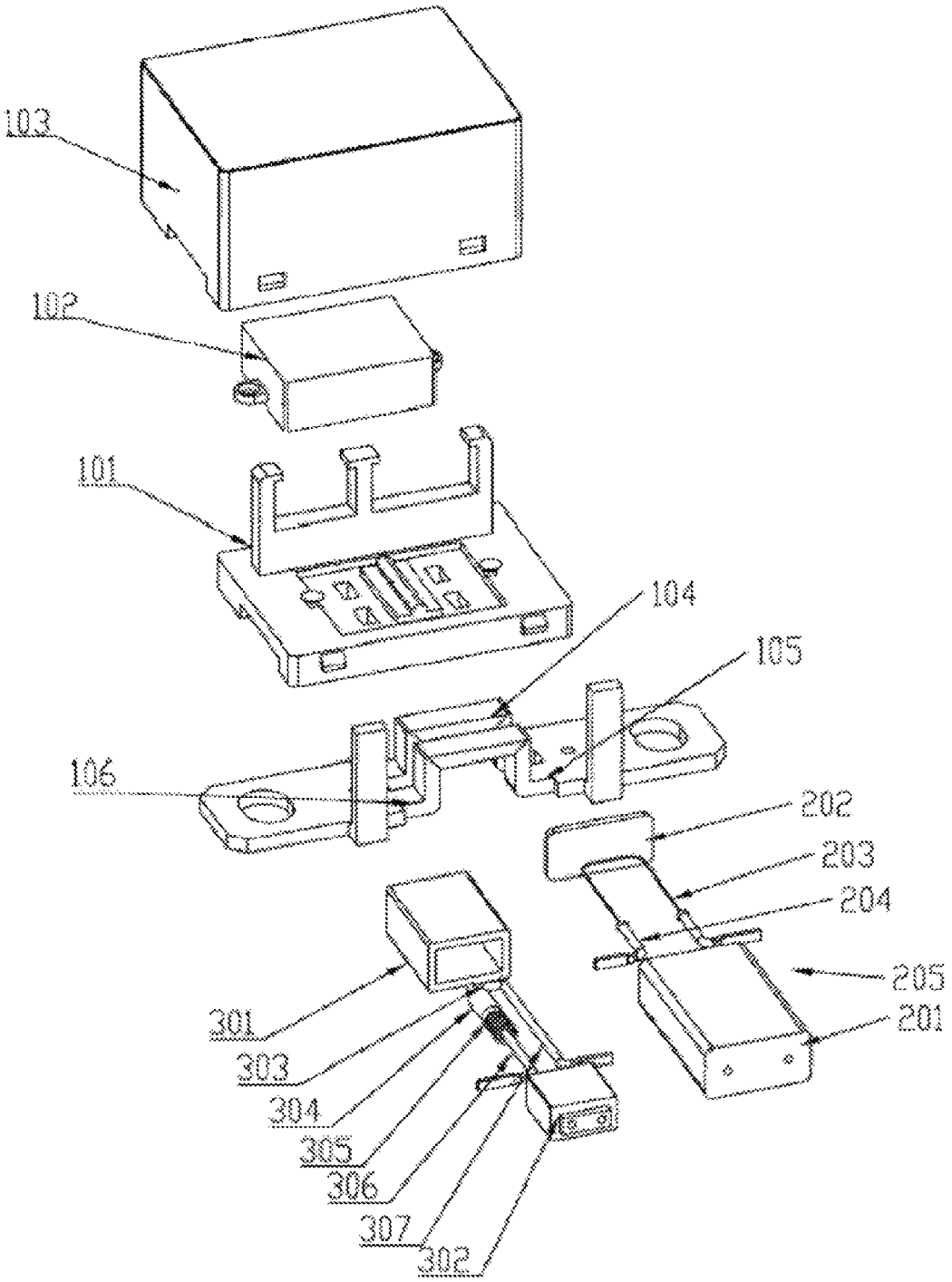
FIG. 2 is a perspective explosive view of Embodiment 1 of the invention.

FIG. 1 and FIG. 2 respectively show the perspective partial profile diagram and the perspective explosive view of Embodiment 1 of the invention. As FIG. 1 and FIG. 2 show, the high-voltage direct-current thermal fuse of the embodiment of the invention includes insulating base 101 and a large casing 103 provided thereon. Regular thermal fuse 100, current fuse 200, and high-voltage low-current thermal fuse 300 are provided inside a cavity formed between insulating base 101 and large casing 103. Among others, high-voltage low-current thermal fuse 300 is connected in series to current fuse 200 sequentially to form a primary branch. Then, the primary branch is connected in parallel to thermal fuse 100. Next, thermal fuse 100 is connected in series into the high-voltage circuit to be protected, to provide the protection for the high-voltage circuit against excessive temperatures.

Please refer to FIG. 2, thermal fuse 100 specifically includes small casing 102 which is arranged on insulating base 101. Right lead of thermal fuse 105 and left lead of thermal fuse 106 are fixedly provided on both sides of insulating base 101. Fusible alloy wire 104 is provided inside the closed cavity formed by insulating base 101 and small casing 102. Fusible alloy wires 104 are welded between left lead 106 and right lead 105 which in the thermal fuse. As FIG. 2 shows, in the embodiment, two pieces of fusible alloy wires 104 provided in parallel are included specifically. In other embodiments, one or two or more pieces of fusible alloy wires that are in parallel or crossways can also be provided if necessary. It should be noted that in the specific implementation process, the number of pieces of fusible alloy wires and the specific cross-sectional area of each piece of fusible alloy wires can be adaptively adjusted by one skilled in the art according to various current flow rates of the thermal fuse. In the embodiment, left lead 106 and right lead 105 presents an L-shape, which are arranged along the central vertical axis of fusible alloy wires 104 symmetrically, and are injected to form a whole together with base 101. Two pieces of fusible alloy wires 104 in parallel are connected between two L-shape left leads 106 and right leads 105 to form a bridge-type connection. Also, the terminals of left lead 106 and right lead 105 reach out of insulating base 101, extending in the direction which is opposite to fusible alloy wires 104 respectively. Fusible alloy wires 104 are made of low-melting conductive alloy material which is sensitive to temperature, and is coated by the fusing agent. When the temperature reaches the fusing temperature of fusible alloy wires 104, fusible alloy wires 104 are fused. With the effects of surface tension and fusing agent, fusible alloy wires 104 shrink towards both ends to become a ball and attach to the ends of two leads, so as to be the fusing switch point in the application circuit, cutting off the circuit.

Current fuse 200 includes casing of current fuse 201 and cover plate 202. Fuse 203 is arranged inside the cavity formed between casing of current fuse 201 and cover plate 202. Among others, fuse 203 is in a shape of bending N-type. Left lead 204 and right lead 205 are connected to both ends of fuse 203 respectively. Left lead 204 and right lead 205 are shaped to extend from the top of the N-type of fuse 203 and have segments in parallel with each other. Left lead 204 and right lead 205 pass through the via holes on casing of current fuse 201 respectively, extending out of casing of current fuse 201 and exposed to the outside, so as to be an electric connection point connecting fuse 203 to an external environment. Fuse 203 is suspended in the N-type cavity, without contacting the internal cavity walls of the N-type cavity. Since fuse 203 inside current fuse 200 is in a shape of bending N-type, current fuse 200 is called N-type current fuse. In order to improve the effectiveness of extinguishing arcs, the N-type cavity also can be filled with arc extinguishing materials such as quartz sand, to stabilize the heat balance of fuse 203. Among others, when the high-voltage low-current thermal fuse is connected in series to N-type current fuse, the breaking current of the high-voltage low-current thermal fuse is less than that of the N-type current fuse.

When current fuse 200 is powered on, the temperature of fuse 203 will increase because of the heat generated from current conversion. When loading normal working current or allowed over-loading current, the heat generated by the current, and the heat which is dissipated by means of radiating, convecting, conducting, and etc. through fuse 203, casing of current fuse 201, and the surrounding environment can reach a balance gradually. If the heat dissipating speed cannot keep up with the heat generating speed, heat will accumulate on the fuse-link to make the temperature of fuse 203 increase. Once the temperature reaches or goes beyond the melting point of fuse 203, it will be liquefied or vaporized to cut off the circuit.

At the fusing moment of fuse 203, usually, the break is from the center point of the N-type towards both sides. An arc is inevitably generated at the breaking point of fuse 203, such that a large number of charged particles are generated from the arc. At the same time, the electric field intensity generated by left lead 204 and right lead 205 that are in parallel in the current fuse is more than multiple times. The diffusion and recombination process of charged particles are more rapid under high electric field intensity, making the gap between electrode leads quickly recover to the insulation state, achieving the aim of extinguishing the arc. Thus, the arc extinguishing protection effect which is multiple times more than that of the normal fuse is achieved, and a safety protection for circuit and human is realized.

Please refer to FIG. 2, high-voltage low-current thermal fuse 300 is a disposable non-resettable fusing device. In the embodiment, the square-shell type thermal fuse is used, which includes the shell consisting of casing of high-voltage low-current thermal fuse 301 and base 302, temperature sensing member sealed inside the casing (e.g., fusible alloy wires 303 which have a low melting point and a good temperature sensitivity, wherein fusible alloy wires 303 is coated with fusing agent), and two leads extending outside the shell. The reference numbers of the two leads are 306, 307 respectively. Among others, fusible alloy wires 303 are welded between left lead 306 and right lead 307. As FIG. 2 shows, left lead 306 and right lead 307 are provided in parallel with each other. The axes of two leads are perpendicular to fusible alloy wires 303 respectively. Fusible alloy wires 303 are specifically welded on the top of axes of left lead 306 and right lead 307. After the left lead 306 and right lead 307 pass through the via holes on base 302 in axial direction, they are bent and extend along the direction which is away from fusible alloy wires 303. Each extending lead is exposed to outside base 302 as an external electric connection point.

A round cavity is further provided inside base 302 where compressing spring 305 and arc extinguishing sleeve 304 are located. Arc extinguishing sleeve 304 and compressing spring 305 are positioned to surround the axis of high-voltage left lead 306. One end of compressing spring 305 which in a compressed state is connected to internal end face of the round cavity of base 302, and the other end contacts arc extinguishing sleeve 304. The end opposite to compressing spring 305 of arc extinguishing sleeve 304 contacts fusible alloy wires 303. Since fusible alloy wires 303 has a certain stiffness under normal temperature, arc extinguishing sleeve 304 pushes against fusible alloy wires 303 under the effect of compressing spring 305. The elasticity of the compressing spring, which is configured in the compressed state, is not sufficient to destroy the welding strength of fusible alloy wires 303 and high-voltage left lead 306 and high-voltage right lead 307.

High-voltage low-current thermal fuse 300 mainly functions as excessive temperature and high-voltage cutting off protection. When the temperature of the region where high-voltage low-current thermal fuse 300 is located reaches the fusing temperature of fusible alloy wires 303 inside high-voltage low-current thermal fuse 300, fusible alloy wires 303 melt. Also, with the help of surface tension and a fusing agent (e.g. special resin), fusible alloy wires 303 shrink towards both ends and become a ball, attaching to the ends of two leads (whose reference numbers are 306 and 307 respectively). Since the circuit where high-voltage low-current thermal fuse 300 is located is a high-voltage circuit, the speed of shrinkage of fusible alloy wires 303 is too slow and the gap between high-voltage left lead 306 and right lead 307 is too short, an arc is likely to be generated. With the generation of a high-voltage arc, liquefied fusible alloy wires 303 has a good fluidity. With the help of the elasticity of compressing spring 305, arc extinguishing sleeve 304 moves along the axis to cut off fusible alloy wires 303. Arc extinguishing sleeve 304 covers high-voltage left lead 306 to insulate the discharging gap between high-voltage left lead 306 and high-voltage right lead 307. Thus, the current circuit is cut off to prevent further damage to other components in the circuit resulting from abnormal increases of temperature or burning caused by the arc.

Figure 3:
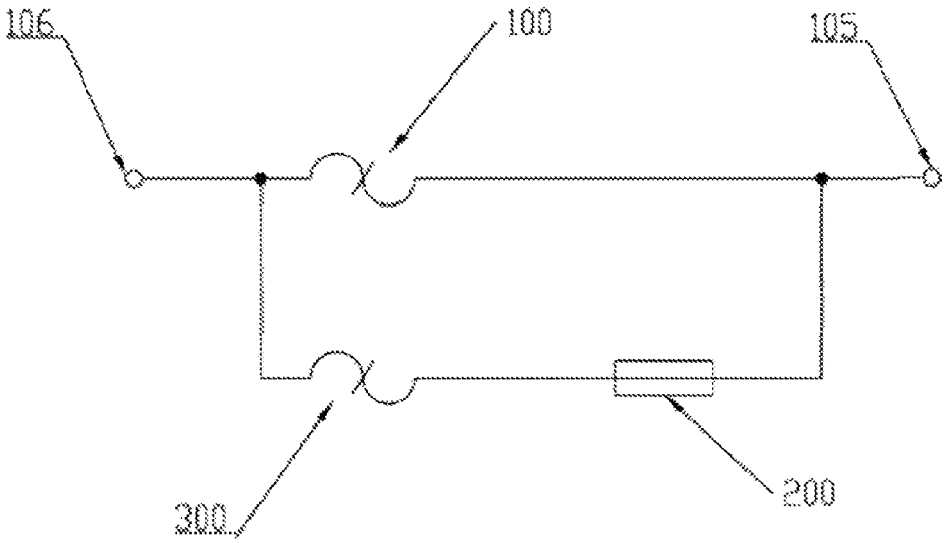
FIG. 3 is a circuit schematic diagram of Embodiment 1 of the invention.

FIG. 3 shows a circuit diagram of Embodiment 1 of the invention. As FIG. 3 shows, current fuse 200 is connected in series to high-voltage low-current thermal fuse 300, and is subsequently connected in parallel to regular thermal fuse 100. Then the left and right leads of regular thermal fuse 100 are connected in series in the high-voltage circuit to be protected to provide protection from excessive temperatures the high-voltage circuit. More specifically, after left lead 204 of current fuse 200 is connected to right lead 307 of high-voltage low-current thermal fuse 300 to form electric connection in series. Right lead 205 of current fuse 200 and left lead 306 of high-voltage low-current thermal fuse 300 are respectively connected to right lead 105 and left lead 106 of thermal fuse 100 to form an electric connection in parallel. Right lead 105 and left lead 106 of regular thermal fuse 100 is connected to the high-voltage circuit, so as to be in series in the circuit which needs protection, so as to provide protection from excessive temperature for the high-voltage circuit.

Furthermore, in order to realize the work of high-voltage direct-current thermal fuse in the embodiment of the invention, the fusing temperature of traditional thermal fuse 100 should be configured to be less than the fusing temperature of high-voltage low-current thermal fuse 300. The resistance of fuse-link in the current fuse should be configured to be more than that of high-voltage low-current thermal fuse.

Thus, when the circuit is a high-voltage high-current circuit, if the outside temperature reaches the fusing temperature of thermal fuse 100, with the help of surface tension and fusing agent, fusible alloy wires 104 fuse off and shrink towards the left and right leads on both ends. Due to the existence of the parallel circuit, the cutting off of fusible alloy wires 104 will not generate arcing. The current will go through the primary branch which is connected in parallel with thermal fuse 100, that is, the branch formed by current fuse 200 connected in series with high-voltage low-current thermal fuse 300. Since the resistance of fuse 203 in current fuse 200 is more than that of high-voltage low-current thermal fuse 300, fuse 203 fuses off first to cut off the parallel circuit. Since current fuse 200 with respect to the linear type fuse, at the fusing-off moment, the electric field intensity generated by the leads in parallel is more than multiple times, the diffusion and recombination process of the charged particles are more rapid under high electric field intensity, making the gap between the electrode leads quickly recovery to the insulation state, achieving the aim of extinguishing the arc. It has an arc extinguishing protection that is multiple times more than that of the normal fuse.

When the circuit is a high-voltage low-current circuit, if the outside temperature reaches the fusing temperature of thermal fuse 100, after fusible alloy wires 104 fuse off, the current goes through the parallel circuit which is formed by current fuse 200 and high-voltage low-current thermal fuse 300. Since the current that goes through the parallel circuit is not sufficient to fuse off current fuse 200, the parallel circuit is not cut off and the outside temperature keeps increasing. When it reaches the fusing temperature of fusible alloy wires 303 of high-voltage low-current thermal fuse 300, fusible alloy wires fuse off, and shrink towards both ends to become a ball, attaching to ends of two leads 306, 307. Since the circuit is a high-voltage circuit, the speed of shrinkage of fusible alloy wires 303 is too slow and the gap between high-voltage left lead, right lead 306, 307 is too short, an arc is likely to be generated. With the generation of the high-voltage arc, liquefied fusible alloy wires 303 has a good fluidity. With the help of the elasticity of compressing spring 305, arc extinguishing sleeve 304 moves along the axis to cut off fusible alloy wires 303. Arc extinguishing sleeve 304 covers high-voltage left lead 306 to insulate the discharging gap between high-voltage left lead 306 and high-voltage right lead 307, so as to cut off the parallel circuit to prevent further damages to the electric appliance resulted from abnormal increasing of temperature or burning caused by the arc.

Embodiment 2

Figure 4:
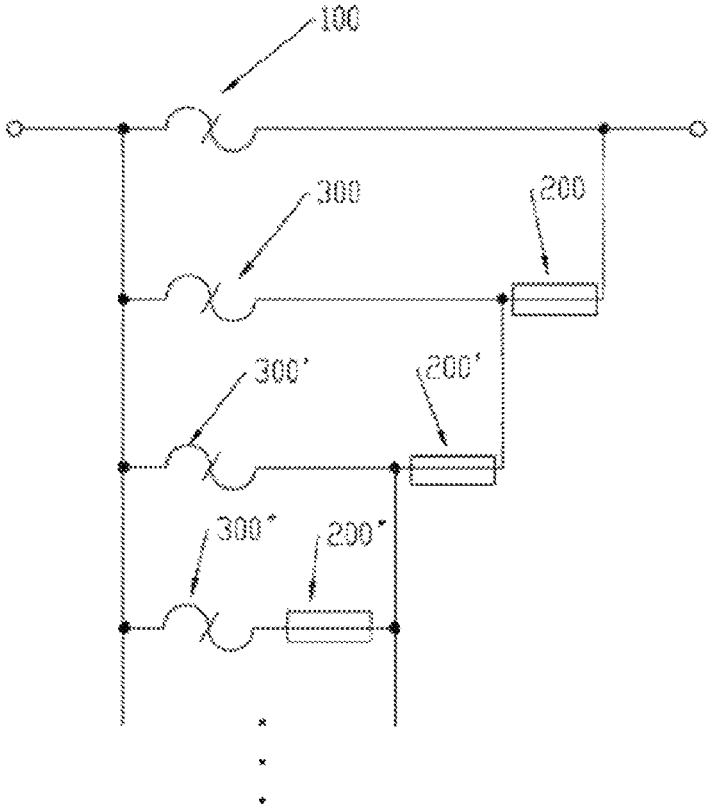
FIG. 4 is a circuit schematic diagram of Embodiment 2 of the invention.

FIG. 4 shows the circuit schematic diagram of Embodiment 2 of the invention. As an expanded solution, in this Embodiment 2, the high-voltage direct-current thermal fuse is composed of thermal fuse 100, current fuse 200, and high-voltage low-current thermal fuse 300 as the same as those in Embodiment 1. Among others, high-voltage low-current thermal fuse 300 is sequentially connected in series to current fuse 200 to form the primary branch. Next, the primary branch is connected in parallel to thermal fuse 100. Thermal fuse 100 is connected in series to the high-voltage circuit to be protected, so as to provide the over-temperature protection for the high-voltage circuit, which is not explained again here.

The differences between Embodiment 1 and Embodiment 2 lie in that: the high-voltage direct-current thermal fuse also includes N secondary branches, and each secondary branch includes the high-voltage low-current thermal fuse sequentially connected in series to the current fuse. Among others, the structure of the high-voltage low-current thermal fuse and that of the current fuse are the same as those of the primary branch, which is not explained again here. When N is equal to 1, the secondary branch is connected in parallel to the high-voltage low-current thermal fuse in the primary branch. When N is more than 1, the Nth secondary branch is connected in parallel to the high-voltage low-current thermal fuse in the (N−1)th secondary branch. As FIG. 4 shows, FIG. 4 includes two secondary branches. N is equal to 2. The first secondary branch includes high-voltage low-current thermal fuse 300' and current fuse 200' that are connected to each other in series sequentially. The second secondary branch includes high-voltage low-current thermal fuse 300" and current fuse 200" that are connected to each other in series sequentially. Among others, the first secondary branch is connected in parallel to high-voltage low-current thermal fuse 300 in the primary branch. The second secondary branch is connected in parallel to high-voltage low-current thermal fuse 300' in the first secondary branch.

In fact, as an expanded solution, the number of the secondary branches is not limited to two in Embodiment 2, and can also be more. The next level of secondary branch is connected in parallel to the high-voltage low-current thermal fuse in the last level of secondary branch. Using the manner of multi-parallel to the high-voltage low-current thermal fuse, the high-voltage low-current thermal fuse can be expendably applied in lightning protection modules. Thus, the protection circuit is separated more effectively and timely to meet effective cutting off of the voltage.

In additional, as another application solution, the high-voltage low-current thermal fuse in above Embodiment 1 and Embodiment 2 can both use the porcelain-tube type thermal fuse. The porcelain-tube type thermal fuse includes insulated porcelain tube, inside which fusible alloy wires that melt at a predetermined temperature are encapsulated. The fusible alloy wires are welded between the right lead and left lead that are axisymmetric. The ends of two leads respectively extend outside the insulated porcelain tube in the direction that is away from the fusible alloy wires. Among others, any of the two leads can be sleeved by an arc extinguishing sleeve and a compressing spring. One end of the arc extinguishing sleeve contacts the fusible alloy wires, and the other end contacts the spring. One end of the spring is connected to the internal end face of the insulated porcelain tube in the compressed state. The elasticity of the spring which in configured in a compressed state is not sufficient to destroy the welding strength between the fusible alloy wires and left, right leads. Other settings are the same as those in Embodiment 1 or 2, which is not explained again here.

Furthermore, as a basic application solution, high-voltage low-current thermal fuse 300 in the embodiment of the invention can be used in the high-voltage direct-current circuit alone (e.g. connecting in series into the high-voltage direct-current circuit). When the circuit to be protected is the high-voltage direct-current circuit, if the outside temperature reaches the fusing temperature of fusible alloy wires 303 in the high-voltage direct-current thermal fuse 300, fusible alloy wires 303 fuse off and shrink towards both ends to become a ball, attaching to the ends of the leads whose reference numbers are 306, 307 respectively. With the generation of high-voltage arc, liquidized fusible alloy wires 303 has a good fluidity. Arc extinguishing sleeve 304 moves along the axis to cut off fusible alloy wires 303 under the effect of the elasticity of compressing spring 305. Arc extinguishing sleeve 304 covers high-voltage left lead 306 to insulate the special discharging gap between the high-voltage left lead 306 and the high-voltage right lead 307, so as to cut off the parallel circuit to prevent further damages to other components in the circuit resulted from the abnormal increasing of temperature or burning caused by the arc.

As another expanded solution, the manner of using a regular thermal fuse connected in parallel to a current fuse can also be used to apply in the high-voltage direct-current circuit. Although the effect of the manner may not be optimal, it can realize the function of circuit cutting-off and arc extinguishing. If outside temperature reaches the fusing temperature of thermal fuse 100, the cutting-off of fusible alloy wires 104 fuse off and shrink towards the right and left leads at both ends. Due to the existence of parallel circuit, the cutting-off of fusible alloy wires 104 will not generate the arc. The current will go through the current fuse connected in parallel to thermal fuse 100. When the current reaches a certain intensity and a certain temperature, fuse 203 of current fuse 200 will fuse off automatically to cut off the current, so as to achieve the function of protecting the circuit to operate safely.

For persons skilled in the art, it is easy to conceive of many modifications and other embodiments of the invention. In the invention, contents shown in the above descriptions and associated drawings have useful technical motivations. Thus, the embodiments of the invention only disclose preferable embodiments, and are not limited to specific embodiments disclosed, but also include various modifications and other embodiments within the scope of the claims. Although in the context, certain specific terms are used, they are only used for a general and descriptive sense, and do not constitute a limitation.

What is claimed is:

1. A high-voltage direct-current thermal fuse, comprising a high-voltage low-current thermal fuse; wherein the high-voltage low-current thermal fuse comprises a casing, a fusible alloy wire, encapsulated inside the casing, and a first lead and a second lead, and the first lead and the second lead extending outside the casing, wherein the fusible alloy wire is connected between the first lead and the second lead; either the first lead or the second lead being sequentially sleeved with an arc extinguishing sleeve and a spring, one end of the arc extinguishing sleeve contacting the fusible alloy wire; the other end of the arc extinguishing sleeve contacting the spring; one end of the spring being connected to an internal end face of the casing; and wherein, the spring is in a compressed state, wherein the high-voltage direct-current thermal fuse further includes a second thermal fuse; the high-voltage low-current thermal fuse being connected in parallel to the second thermal fuse; the fusing temperature of the high-voltage low-current thermal fuse being higher than that of the second thermal fuse.

2. The high-voltage direct-current thermal fuse according to the claim 1, wherein the high-voltage low-current thermal fuse is further connected in series with a current fuse to form a primary branch, the primary branch being connected in parallel to the second thermal fuse; wherein the resistance of the current fuse is more than that of the high-voltage low-current thermal fuse.

3. The high-voltage direct-current thermal fuse according to the claim 2, wherein the current fuse is a tube fuse, which includes a metal fusing wire inside the tube and a tube body with both ends having a metal connecting terminal.

4. The high-voltage direct-current thermal fuse according to the claim 2, wherein the current fuse is N-type current fuse, wherein the current fuse includes a N-type fuse-link and two leads being connected to the N-type fuse-link; the two leads extending from two ends of the N-type fuse-link respectively, wherein each of the two leads has a segment, both segments being parallel to each other.

5. The high-voltage direct-current thermal fuse according to claim 2, wherein the high-voltage direct-current thermal fuse also includes N secondary branches; the secondary branches including high-voltage low-current thermal fuse and the current fuse that are connected in series sequentially; wherein, when N equals to 1, the secondary branch is connected in parallel to the high-voltage low-current thermal fuse in the primary branch; and when N is more than 1, the Nth secondary branch is connected in parallel to the high-voltage low-current thermal fuse in the (N−1)th secondary branch.

6. The high-voltage direct-current thermal fuse according to the claim 1, wherein the second thermal fuse is provided with at least one fusible alloy wire; the at least one fusible alloy wire is provided between the two leads.

7. The high-voltage direct-current thermal fuse according to the claim 6, wherein the second thermal fuse includes at least two pieces of fusible alloy wires; the at least two pieces of fusible alloy wires are provided in parallel or crossways between the two leads.

* * * * *